US005351885A

United States Patent [19]

Manabe

[11] Patent Number: 5,351,885

[45] Date of Patent: Oct. 4, 1994

[54] LIQUID JETTING APPARATUS INCLUDING POSITION CHANGE AND DETECTOR MECHANISMS

[75] Inventor: Nobuyuki Manabe, Fujisawa, Japan

[73] Assignee: Taiho Industries Co., Ltd., Tokyo, Japan

[21] Appl. No.: 174,012

[22] Filed: Dec. 28, 1993

[30] Foreign Application Priority Data

Apr. 5, 1993 [JP] Japan ..... 5-100064

[51] Int. Cl.[5] ..... B05B 3/02; B05B 3/12

[52] U.S. Cl. ..... 239/73; 239/227; 239/263.1; 239/263.3; 134/167 R

[58] Field of Search ..... 239/73, 227, 242, 263.1, 239/263.3; 134/167 R, 168 R

[56] References Cited

U.S. PATENT DOCUMENTS

| | | | |
|---|---|---|---|
| 928,386 | 7/1909 | Johnson | 239/227 |
| 2,773,665 | 12/1956 | Berger et al. | 239/263.1 X |
| 2,845,303 | 7/1958 | King, Jr. | 239/227 |
| 3,472,451 | 10/1969 | Orem et al. | 134/167 R |
| 4,426,233 | 1/1984 | Manabe et al. . | |
| 4,515,312 | 5/1985 | Manabe et al. | 239/227 |
| 4,716,917 | 1/1988 | Schmidt | 239/227 X |

FOREIGN PATENT DOCUMENTS

| | | | |
|---|---|---|---|
| 520799 | 2/1921 | France | 239/227 |

*Primary Examiner*—William Grant

*Attorney, Agent, or Firm*—Oblon, Spivak, McClelland, Maier & Neustadt

[57] ABSTRACT

A liquid jetting apparatus includes a drive mechanism, fixed, rotating and jetting cylinder sections connected in order, first rotation transmission mechanism connected to the drive mechanism and having a first operating element, second rotation transmission mechanism connected to the drive mechanism and having a second operating element, the rotational speed of the second rotation transmission mechanism being slightly different from that of the first rotation transmission mechanism, a first operating rod connected at its one end to the first rotation transmission mechanism through a position change mechanism and at its other end to the jetting cylinder section, a second operating rod connected at its one end to the second rotation transmission mechanism and at its other end to the rotating cylinder section, and a detector for detecting the positions of the first operating element and the second operating element and reversing the direction of rotation of the drive mechanism when both operating elements are present at a prescribed position.

2 Claims, 6 Drawing Sheets

LIQUID JETTING APPARATUS INCLUDING POSITION CHANGE AND DETECTOR MECHANISMS

BACKGROUND OF THE INVENTION

1. Field of the Invention

This invention relates to a liquid jetting apparatus, more particularly to a liquid jetting apparatus used, for example, to fluidize sludge accumulated in an oil tank by jetting it with a washing liquid or the like.

2. Description of the Prior Art

Numerous liquid jetting apparatuses for use in cleaning the interiors of oil tanks have been proposed, including those described in Japanese Utility Model Appln. Publications Hei 4-33275, Sho 58-9674, Sho 59-36281 and Sho 58-23435, Japanese Utility Model Appln. Public Disclosure-Hei 4-110158, Japanese Patent. Appln. Public Disclosure Sho 56-15855 and U.S. Pat. No. 4,426,233. All of these apparatuses are supplied high-pressure washing liquid whose high pressure is used to rotate a turbine and, in turn, to rotate or swing the nozzle section that jets the washing liquid.

In a method which rotates a turbine using the high pressure of supplied washing liquid, however, the jetting pressure of the washing liquid is naturally lowered by the resistance of the turbine. Under some circumstances, this reduction of the washing liquid jetting pressure prolongs the period required for breaking down solidified sludge in an oil tank or makes it impossible to achieve adequate breakdown.

In addition, a particular problem is encountered when oil is used as the washing liquid. Since there is no way of preventing the oil from getting into the turbine and other mechanical parts, the oil is liable to be ignited by frictional heat or sparks produced by the operation of the mechanical sections.

This invention was accomplished in the light of the foregoing circumstances and has as one of its objects to provide a liquid jetting apparatus which does not reduce the jetting pressure of the washing liquid.

Another object of the invention is to provide a liquid jetting apparatus that ensures safe, fire-free operation since it does not include a turbine which could produce frictional heat or sparks.

Another object of the invention is to provide a liquid jetting apparatus that with a simple configuration enables washing liquid to be jetted in the desired direction and over the desired range.

SUMMARY OF THE INVENTION

For achieving these objects, the invention provides a liquid jetting apparatus comprising drive means including a motor, a fixed cylinder section disposed under the drive means, a rotating cylinder section rotatably disposed at the lower end of the fixed cylinder section and having a free end with an inclined end surface, a jetting cylinder section having an inclined upper end face-to-face with the inclined end surface of the rotating cylinder section and a lower end equipped with a liquid jetting nozzle, the jetting cylinder section being rotatably connected to the rotating cylinder section, first rotation transmission means connected to the drive means and having a first operating element, second rotation transmission means connected to the drive means and having a second operating element, the rotational speed of the second rotation transmission means being slightly different from that of the first rotation transmission means, a first operating rod connected at its one end to the first rotation transmission means through a position change means and at its other end to the jetting cylinder section, a second operating rod connected at its one end to the second rotation transmission means and at its other end to the rotating cylinder section, and detection means for detecting the positions of the first operating element and the second operating element and reversing the direction of rotation of the drive means when both operating elements are present at a prescribed position.

Thus, instead of using the pressure of the supplied washing liquid for rotating and swinging the nozzle section the invention provides a separate drive system for this purpose. There is therefore no reduction of the washing liquid jetting pressure. Moreover, the apparatus is extremely safe with regard to the occurrence of fire since it has no turbine to produce frictional heat or sparks. Further, owing to the provision of the third rotation transmission means, the two means can be operated to control both the direction and the swing angle of the jetting cylinder section, whereby the jetting of the washing liquid in the desired direction and over the desired range can be conducted with ease.

The above and other features of the present invention will become apparent from the following description made with reference to the drawings.

DESCRIPTION OF THE PREFERRED EMBODIMENT

Figure 1:
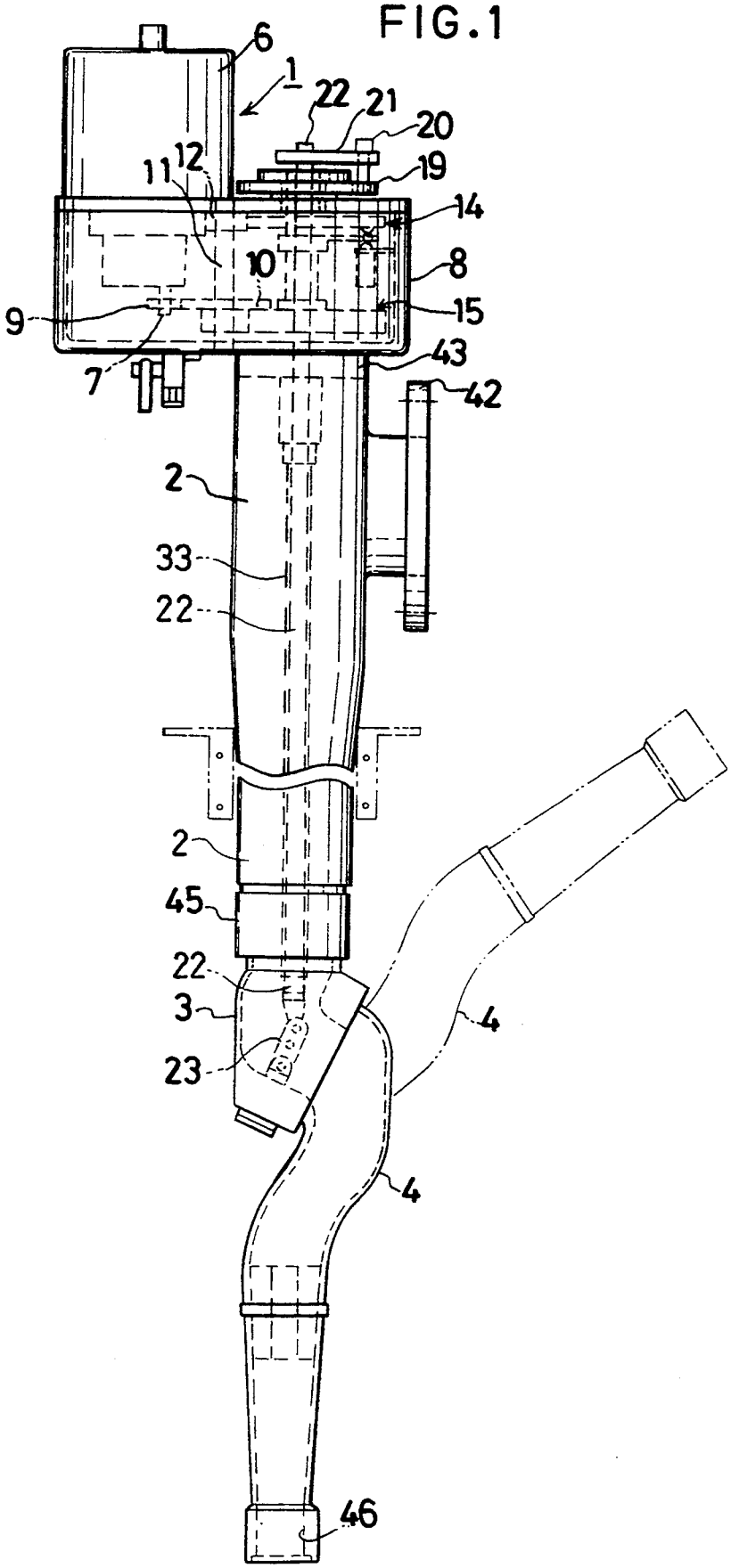
FIG. 1 is a side view showing an embodiment of the liquid jetting apparatus according to the present invention.

The drawings show an embodiment of the liquid jetting apparatus according to this invention applied to an oil tank washing apparatus.

Briefly described, the liquid jetting apparatus according to the present invention comprises a drive mechanism 1, a fixed cylinder section 2 provided below the drive mechanism 1, a rotating cylinder section 3 connected to the lower end of the fixed cylinder section 2 and a jetting cylinder section 4 connected to the lower end of the rotating cylinder section 3.

In addition to having the fixed cylinder section 2 provided beneath it, the drive mechanism 1 includes a drive means 6, for example, a motor, that is connected with a power source (not shown). A drive shaft 7 of the drive means 6 is housed in a generally disk-shaped housing 8 which also houses a rotating shaft 11 fitted with a rotating gear 10 that meshes with a drive gear 9 fitted on the drive shaft 7. The shaft 11 is also fitted above with a first transmission gear 12 and below with a second transmission gear 13. The first transmission gear 12 and the second transmission gear 13 have a slightly different number of teeth. A first rotation transmission mechanism 14 is connected to the first transmission gear 12 and a second rotation transmission mechanism 15 is connected to the second transmission gear 13.

The first rotation transmission mechanism 14 consists of a first gear 16 meshed with the first transmission gear 12, a first short cylinder member 17 standing on and integral with the upper surface of the first gear 16, and a disk-shaped position change plate 19 fixed on the top of the first short cylinder member 17 and having a plurality of apertures 18 formed along its outer edge. On the position change plate 19 is provided a third rotation transmission mechanism (direction change mechanism) 29 consisting of an arm-like connecting plate 21 having a long first operating rod 22 fixed at one end and an extractable pin 20 at the other end. Inserting the pin 20 into an aperture 18 of the position change plate 19 links the position change plate 19 with the connecting plate 21 so that the rotation of the first transmission gear 12 is reduced and transmitted to the first operating rod 22 through the first rotation transmission mechanism 14 and the third rotation transmission mechanism 29.

Figure 7:
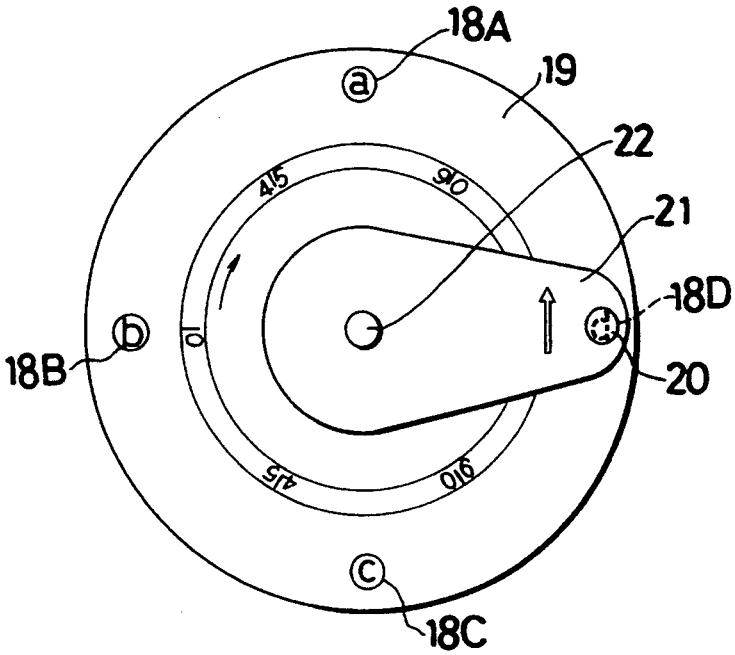
FIG. 7 is a plan view showing the position change mechanism FIG. 6.

In the embodiment of FIG. 7, the position change plate 19 is provided about its periphery with four apertures 18A, 18B, 18C, 18D. Extracting the pin 20 from the aperture in which it is inserted allows the first operating rod 22 to rotate freely with the connecting plate 21. By rotating the connecting plate 21 (and the first operating rod 22) in the appropriate direction with the pin 20 extracted and then inserting the pin 20 in an appropriate aperture of the position change plate 19 it is possible to set the start position of the swinging action of the jetting cylinder section 4, as will be explained below.

Figure 5:
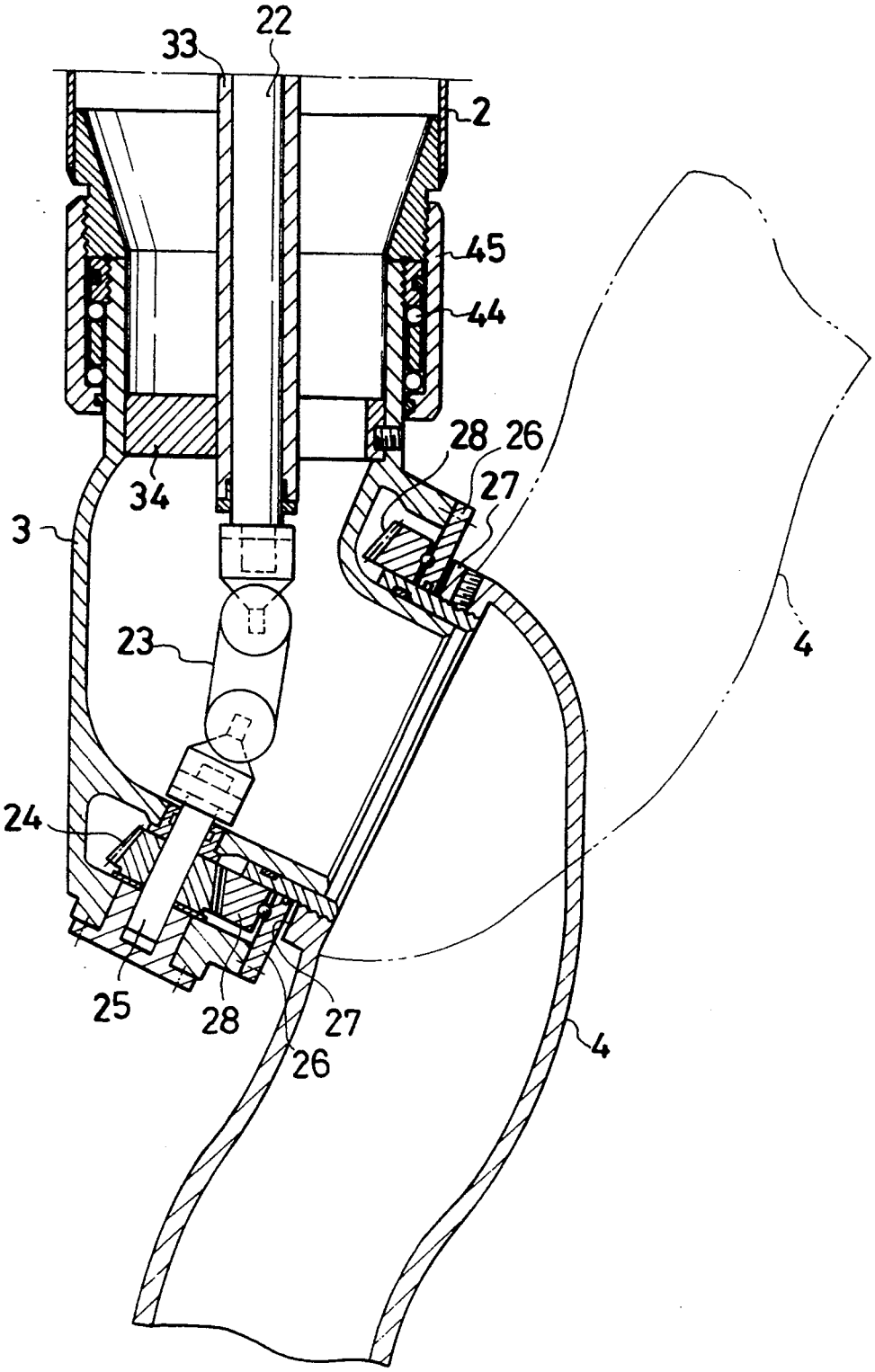
FIG. 5 is a sectional view showing a connecting section between a rotating cylinder section and a jetting cylinder section of the liquid jetting apparatus of FIG. 1.

As shown in FIG. 5, the lower end of the first operating rod 22 is connected through a flexible joint 23 to a short rod member 25 fitted with a second gear 24. The short rod member 25 is rotatably mounted in the lower end of the rotating cylinder section 3. The rotating cylinder section 3 terminates in an inclined end surface 26 in face-to-face contact with an inclined end 27 of the jetting cylinder section 4 and a third gear 28 fixed to the inclined end 27 engages with the second gear 24. Therefore, when the pin 20 is inserted in an aperture 18 of the position change plate 19, the rotation of the first transmission gear 12 rotates the first operating rod 22, whereby the jetting cylinder section 4 is swung about its inclined end 27. In addition, the position from which the jetting cylinder section 4 begins swinging can be adjusted by selecting the aperture of the position change plate 19 into which the pin 20 is inserted.

The second rotation transmission mechanism 15 consists of a fourth gear 30 engaged with the second transmission gear 13 and a second short cylinder 31 depending from the lower surface of the fourth gear 30. A long, pipe-like second operating rod 33 is fixed to the lower end of the second short cylinder 31 through a short, cylindrical connecting member 32. As shown in FIG. 5, the lower portion of the second operating rod 33 is connected to the rotating cylinder section 3 through a fixing member 34 and the jetting cylinder section 4 is connected to the open end of the rotating cylinder section 3 so as to be capable of swinging (sweeping) motion. Therefore, the rotation of the second transmission gear 13 rotates the second operating rod 33, whereby the rotating cylinder section 3 and the jetting cylinder section 4 can be rotated about the second operating rod 33. Smooth rotation of the second short cylinder 31 is ensured by mounting it with respect to the fixed cylinder section 2 via a bearing 35. For ensuring that no interference arises between the rotation of the first operating rod 22 and the rotation of the second short cylinder 31 and the second operating rod 33, the first operating rod 22 is positioned within the hollow interiors of the second short cylinder 31 to be freely rotatable with respect thereto.

Figure 6:
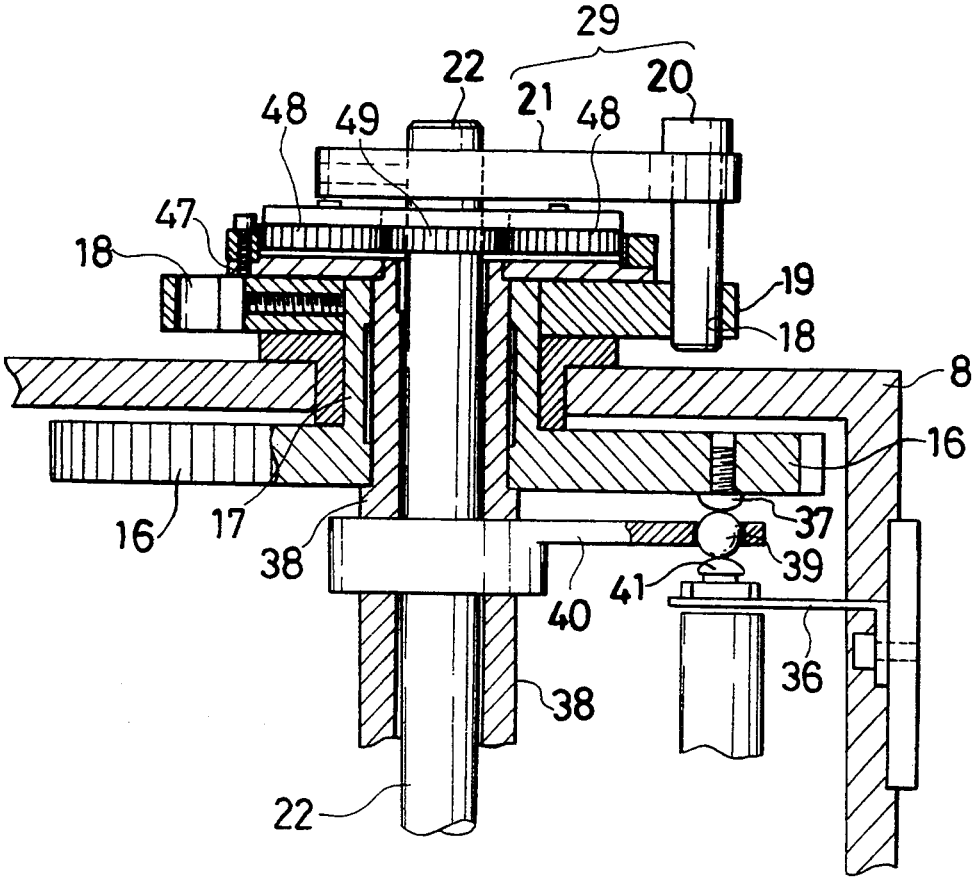
FIG. 6 is a partially cut-away side view of a position change mechanism and a detector of the liquid jetting apparatus of FIG. 1.

As shown in FIG. 6, a first operating element 37 is provided on the undersurface of the first gear 16 of the first rotation transmission mechanism 14 and a second operating element 39 is positioned under the first operating element 37 by a support piece 40 projecting laterally from an intermediate portion of a third short cylinder 38 provided to stand on the upper surface of the fourth gear 30 of the second rotation transmission mechanism 15. In addition, a detection member 41 is positioned under the second operating element 39 by a support arm 36 extending from the inner wall of the housing 8. The first operating element 37, the second operating element 39 and the detection member 41 constitute a rotation sync detector.

Since, as mentioned earlier, the first transmission gear 12 and the second transmission gear 13 differ slightly in the number of their teeth, the rotational speeds of the first gear 16 and the support piece 40 differ slightly so that the first operating element 37 and the second operating element 39 are present at the detection member 41 only once every prescribed period. When they are both positioned at the detection member 41, a communication circuit (not shown) sends a signal to the drive means 6 for rotating it in the opposite direction. As a result, the direction of rotation of the rotating cylinder section 3 and the jetting cylinder section 4 reverses periodically, as does the swing direction of the jetting cylinder section 4.

Figure 3:
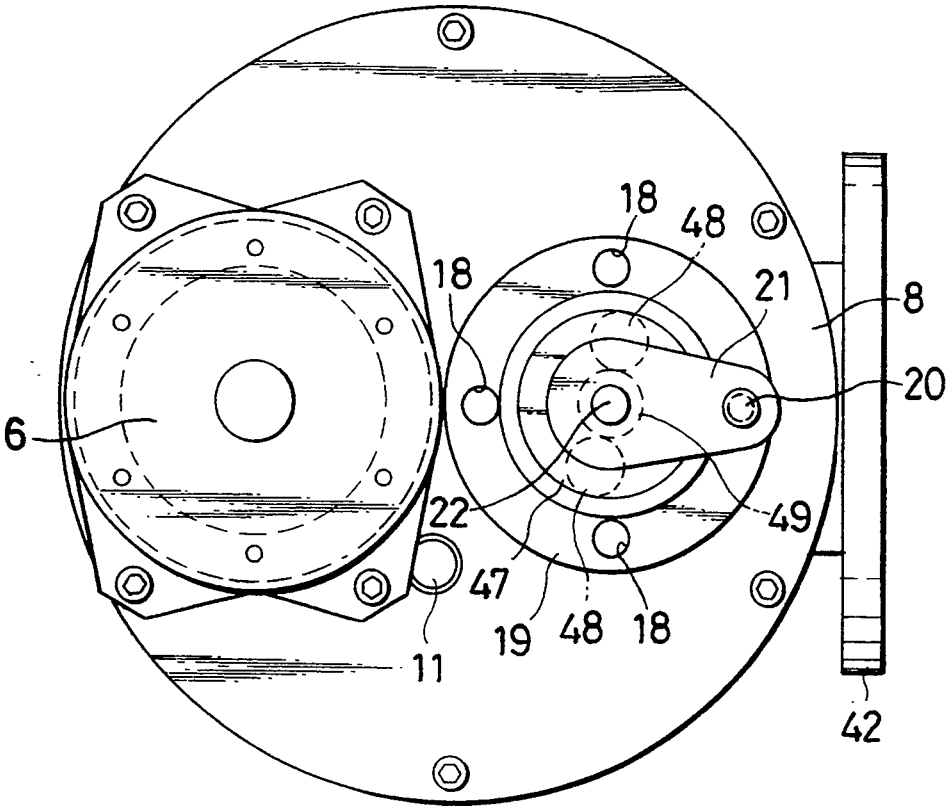
FIG. 3 is a plan view of the liquid jetting apparatus of FIG. 1.
Figure 4:
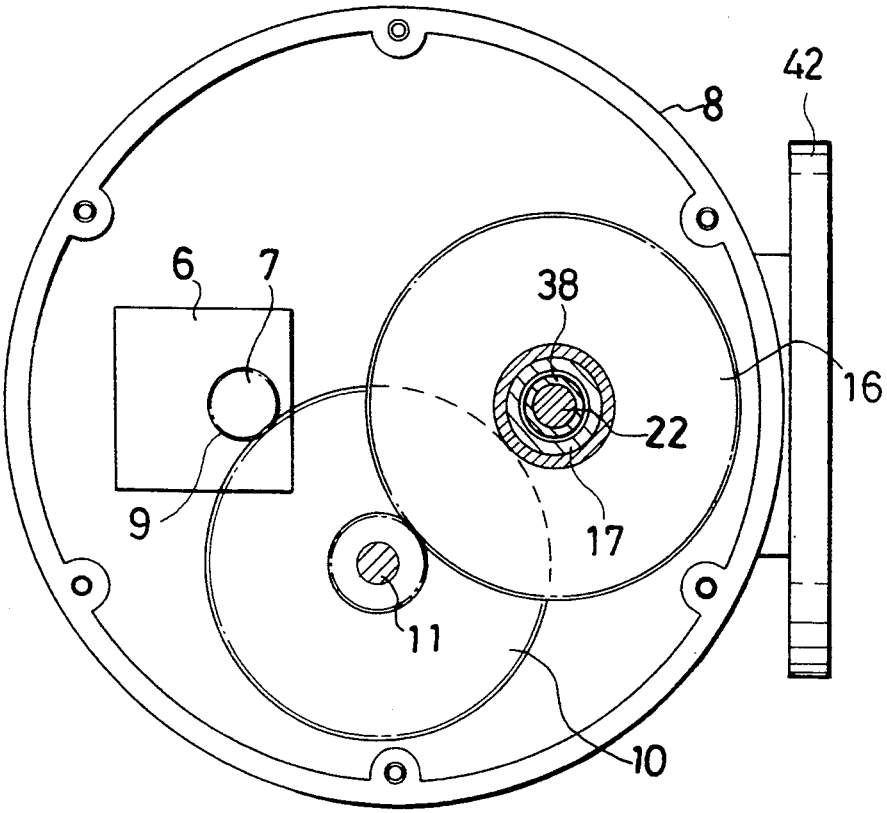
FIG. 4 is a sectional view taken along line IV—IV in FIG. 2.

As shown in FIG. 6, a disk-shaped frame 47 is fixed to top of the third short cylinder 38 and, as shown in broken lines in FIG. 3, a sun gear 49 rotatable with the first operating rod 22 and a pair of planetary gears 48 engaged on one side with the sun gear 49 and on the other side with gear teeth provided on the inner periphery of the frame 47 are provided inside the frame 47. The frame 47 thus supports the upper end of the first operating rod 22.

Figure 2:
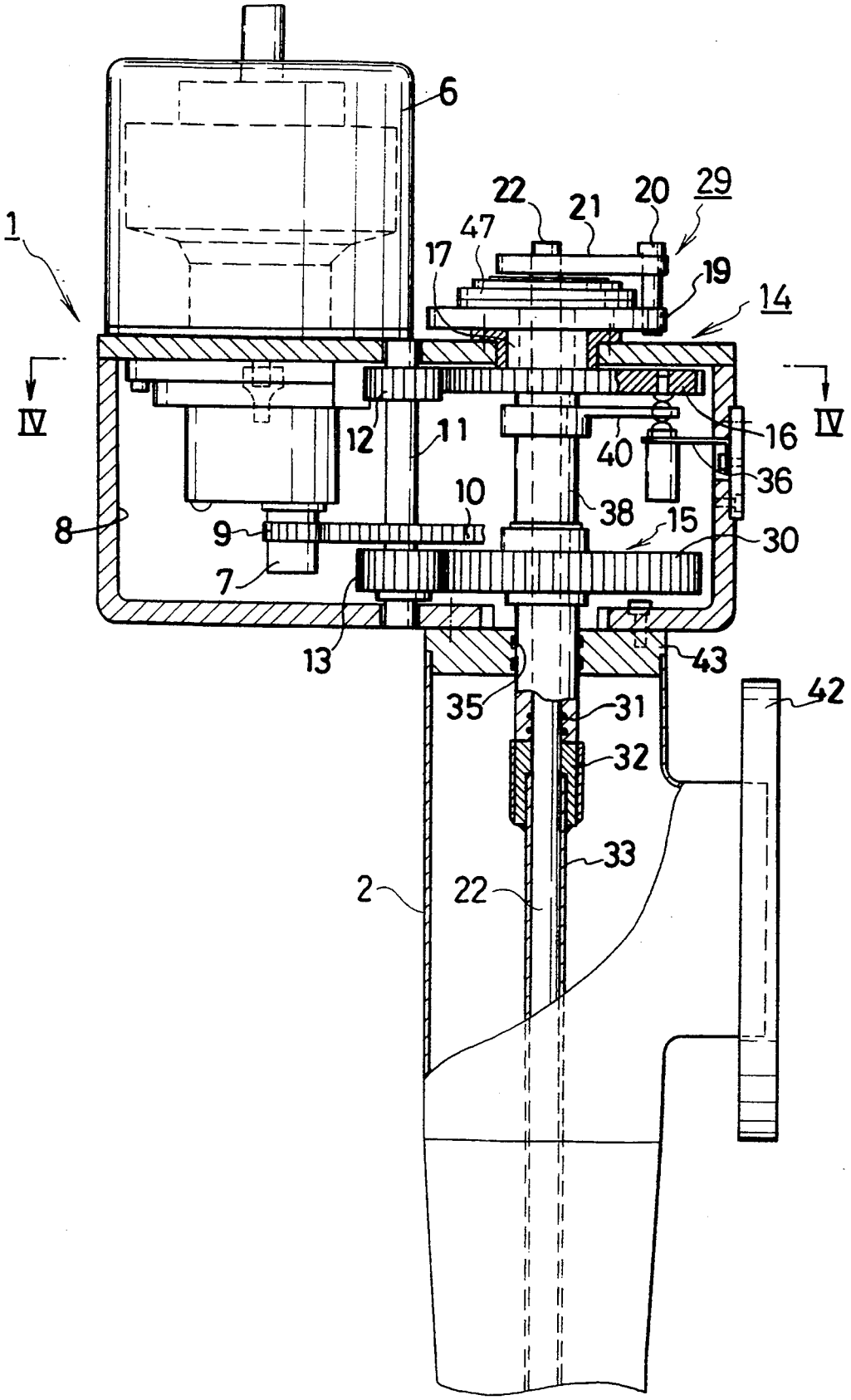
FIG. 2 is a partially cut-away enlarged side view showing the structure of an essential part of the liquid jetting apparatus of FIG. 1.

As best shown in FIG. 2, the fixed cylinder section 2 is equipped with a flange section 42 for connection with a washing liquid supply unit (not shown) and is fitted at its upper end with a seal 43 for preventing washing liquid from getting into the housing 8. The inner surface of the seal 43 is equipped with the aforementioned bearing 35 for supporting and ensuring smooth rotation of the second short cylinder 31 of the second rotation transmission mechanism 15. As shown in FIG. 5, a connecting member 45 with an internally fitted bearing 44 is fixed on the lower end of the fixed cylinder section 2. The rotating cylinder section 3 is rotatably supported by the connecting member 45. As shown in FIG. 1, the jetting cylinder section 4 swingably connected to the rotating cylinder section 3 is equipped with a liquid jetting nozzle 46 from which the supplied washing liquid is jetted at high pressure. The jetting cylinder section 4 is a curved pipe configured to point straight down at the bottom of its swinging rotation.

When washing liquid is fed to the liquid jetting apparatus constituted in the foregoing manner through the flange section 42 and the drive means 6 is turned ON, washing liquid is jetted from the liquid jetting nozzle 46 as the jetting cylinder section 4 slowly swings owing to the rotation of the rotating shaft 11 transmitted through the first rotation transmission mechanism 14 and also rotates owing to the action of the second rotation transmission mechanism 15.

Since, differently from in the prior art jetting apparatuses, the swinging of the jetting cylinder section 4 and the rotation of the rotating cylinder section 3 and the jetting cylinder section 4 are not powered by the delivery pressure of the supplied washing liquid, there is no risk of fire etc. and the jetting pressure of the liquid is not reduced.

Figure 8A:
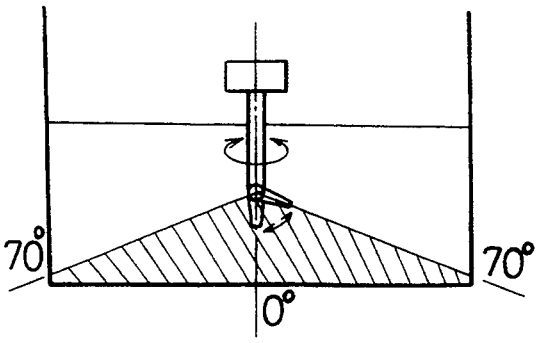
FIGS. 8(*a*) and 8(*b*) are diagrams for explaining the jetting direction range set by the position change mechanism and the detector.
Figure 8B:
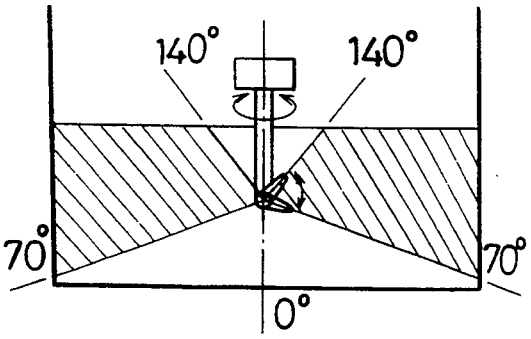

The swing direction and swing angle range of the jetting cylinder section 4 is controlled by means of the position change plate 19. The detector detects when the first operating element 37 and the second operating element 39 are aligned in contact with the detection member 41 and at the time of the detection invokes control to reverse the driving direction of the drive means 6. This enables regulation of the width over which the jetting cylinder section 4 is swung as, for instance, shown in FIG. 8. More specifically, FIG. 8(*a*) relates to the case where the pin 20 is inserted in the aperture 18B of the position change plate 19 and the numbers of teeth of the first transmission gear 12, the second transmission gear 13, the first gear 16 and the fourth gear 30 are selected such that the first operating element 37 and the second operating element 39 align in contact with the detection member 41 when the position change plate 19 has made a quarter rotation. Under these conditions, the jetting cylinder section 4 swings over a range starting from straight down and extending 70 degrees upward, thus making it possible to jet high-pressure liquid over substantially the whole bottom surface of the tank. FIG. 8(*b*) relates to the case where the number of teeth of the respective gears is left unchanged but the apparatus is operated with the pin 20 inserted in the aperture 18A of the position change plate 19. Under these conditions, the jetting cylinder section 4 swings over a range starting 70 degrees upward of straight down and extending upward by another 70 degrees, thus making it possible to jet high-pressure liquid onto the side walls and ceiling of the tank. Thus the high-pressure liquid jetting direction can be changed by selecting the position at which the pin 20 is inserted in the position change plate 19 and, for example, can be appropriately adjusted in response to the location etc. of the sludge deposited in the oil tank. Moreover, by appropriately determining the number of teeth of the gears 12, 13, 16 and 30, it is possible to set the swing angle of the jetting cylinder section 4 as desired.

Although the invention has been explained with reference to an embodiment applied to an oil tank washing apparatus, it is in no way limited to the described embodiment but changes and modifications may be made within the scope of the appended claims.

As explained in the foregoing, the liquid jetting apparatus according to this invention is adapted such that while the first rotation transmission mechanism swings the jetting cylinder section the second rotation transmission mechanism rotates both the jetting cylinder section and the rotating cylinder section 3. Since this makes it possible to jet liquid in almost all directions, it is possible to break down, fluidize and discharge sludge in the oil tank by means of the jetted liquid.

Moreover, since a single drive means is used for swinging the jetting cylinder section and rotating the rotating cylinder section and the jetting cylinder section, energy consumption can be reduced. In addition, unlike in the prior art liquid jetting apparatus, the means for driving the apparatus is not the delivery pressure of the supplied washing liquid and, therefore, there is no risk of fire etc. and the liquid jetting pressure is high. Because of this, the breakdown effect and fluidization effect with respect to sludge in an oil tank, for example, is very high.

Since the detector switches over the drive means with the first and second operating elements and the detector in an integrally controlled state, it is possible to set the swing angle of the jetting cylinder section so as to focus the jetted liquid within a prescribed range.

Furthermore, the provision of the position change mechanism in the third rotation transmission mechanism 29 makes it possible to appropriately set the start position of the swinging action of the jetting cylinder section 4, which in combination with the aforesaid detector, makes it possible to specify the range of liquid jetting to within a desired region. When the apparatus is used for cleaning an oil tank, therefore, the washing liquid jetting efficiency can be maximized in response to the location, condition, etc. of the sludge in the oil tank, thus making it possible to achieve optimum sludge fluidization and discharge.

What is claimed is:

1. A liquid jetting apparatus comprising:

a drive mechanism including a motor, a fixed cylinder section disposed under the drive mechanism, a rotating cylinder section rotatably disposed at the lower end of the fixed cylinder section and having a free end with an inclined end surface, a jetting cylinder section having an inclined upper end face-to-face with the inclined end surface of the rotating cylinder section and a lower end equipped with a liquid jetting nozzle, the jetting cylinder section being rotatably connected to the rotating cylinder section, a first rotation transmission mechanism connected to the drive mechanism and having a first operating element, a second rotation transmission mechanism connected to the drive mechanism and having a second operating element, the rotational speed of the second transmission mechanism being slightly different from that of the first rotation transmission mechanism, a first operating rod connected at one end to the first rotation transmission mechanism through a position change mechanism and at its other end to the jetting cylinder section, a second operating rod connected at one end to the second rotation transmission mechanism and at its other end to the rotating cylinder section, and a detection mechanism for detecting the positions of the first operating element and the second operating element and reversing the direction of rotation of the drive mechanism when both operating elements are present at a prescribed position.

2. A liquid jetting apparatus according to claim 1, wherein the position change mechanism comprises a disk-shaped position change plate connected to the first rotation transmission mechanism and having a plurality of apertures along its periphery, a connecting plate arm fixed at one end to the first operating rod, and a pin having one end connected to the other end of the connecting plate arm and having the other end selectively inserted into one of the apertures in the periphery of the position change plate.

* * * * *